US006270215B1

(12) United States Patent
Miyasaka et al.

(10) Patent No.: US 6,270,215 B1
(45) Date of Patent: Aug. 7, 2001

(54) INKJET PRINTER

(75) Inventors: Toshiaki Miyasaka; Tsuyoshi Ohtani; Takeshi Namiki; Shinya Nozawa, all of Tokyo (JP)

(73) Assignee: Mutch Industries Ltd., Tokyo (JP)

( * ) Notice: Subject to any disclaimer, the term of this patent is extended or adjusted under 35 U.S.C. 154(b) by 0 days.

(21) Appl. No.: 09/225,674

(22) Filed: Jan. 6, 1999

(30) Foreign Application Priority Data

Jan. 21, 1998 (JP) ..... 10-024013

(51) Int. Cl.[7] ..... B41J 2/01
(52) U.S. Cl. ..... 347/104; 347/30; 400/656
(58) Field of Search ..... 347/104, 30; 271/188; 400/656; 346/134

(56) References Cited

U.S. PATENT DOCUMENTS 5,874,979 * 2/1999 Ohyama ..... 347/104
6,038,776 * 3/2000 Yamada et al. ..... 347/104

FOREIGN PATENT DOCUMENTS

JP 59155075
A * 9/1984 (JP) ..... 400/656
JP 60090785
A * 5/1985 (JP) ..... 400/656
JP 11301880
A * 11/1999 (JP) ..... B41J/13/00

* cited by examiner

*Primary Examiner*—John Barlow
*Assistant Examiner*—M. Shah
(74) *Attorney, Agent, or Firm*—Sughrue, Mion, Zinn, Macpeak & Seas, PLLC

(57) ABSTRACT

At least both sides of the recording medium (10) are sandwiched by means of the drive roller (14) and the pinch roller (34), and the recording medium (10) is carried onto the drafting member (12) by the rotation of the drive roller (14). The recording head (22) reciprocatingly shifts in a direction perpendicular to the carrying direction of the recording medium (10) on the drafting position of the drafting member (12). The suction force is generated by the suction device (36) in a predetermined range of the drafting member and surrounding the drafting member (12), and the recording medium (10) is attracted to the drafting member (12). The unevenness guide unit (19) having the suction holes is formed on the drafting member (12), and the recording medium (10) is adsorbed to the unevenness guide unit (19) by means of the suction force of the suction device (36). The unevenness guide unit (19) comprises a plurality of convex stripes disposed in a row which extend in an X-axis direction in parallel with the carrying direction of the recording medium (10) and concave grooves that are adjacent to the convex stripes, and the floating of the recording medium (10) over the drafting member (12) is prevented by the mutual operation of the suction forces of the unevenness guide unit (19) and the suction device (36).

12 Claims, 5 Drawing Sheets

(A)

(B)

INKJET PRINTER

FIELD OF TECHNOLOGY TO WHICH THIS INVENTION BELONGS

The present invention relates to raster-type printers (plotters) such as inkjet type and the like which are used as output equipment for CAD computers, and more particularly, relates to printers provided with a paper float preventing mechanism that keeps a recording medium from floating on a paper support surface in a printing unit.

BACKGROUND OF THE INVENTION

In the inkjet printers of this kind, when ink is discharged onto the recording medium, an influence of wave-like deformation such as crumpled paper (hereinafter called cockling) must be eliminated as much as possible, and an interval between a recording medium and a recording head must be maintained constant. Furthermore, a paper floating from above a platen toward a direction of the head must be prevented. In order to solve the problems mentioned in the foregoing, an inkjet recording device is disclosed in Japanese patent laid open publication H9-48161 wherein a plurality of concave portions and a plurality of convex portions are provided on an upper portion of the platen, and furthermore, a paper holding plate is disposed to be in contact with the plurality of concave portions, and projections are provided on the paper holding plate at positions corresponding to the plurality of concave portions. Furthermore, in Japanese patent laid open publication H7-256955, a printer mechanism provided with ribs on an upper surface of the platen as a countermeasure of cockling is disclosed.

Furthermore, generally, as a paper feeding mechanism for inkjet plotter (printer), for example, as being disclosed in Japanese patent laid open publication H9-11566, [mechanism wherein a recording paper is retained under pressure by means of a main roller and a holding roller of drum type, and is sandwiched by means of a subroller and a spur type roller, and thus, the floating of the paper is prevented and is carried toward a discharge outlet along an upper position guide plate while it being in tight contact] is employed.

Moreover, in inkjet plotter (printer) of pinch roller type has been developed wherein the paper is caused to make a tight contact on a flat drafting member formed with a plurality of ventilation holes by means of a suction force of a suction device, and both sides of the paper are sandwiched by means of a drive roller and a pinch roller, and the paper is fed in a predetermined X-axis by the rotation of the drive roller while the inkjet type recording head is caused to reciprocate in a Y-axis direction to perform a recording on the paper by means of the recording head. Furthermore, a mechanism is known wherein an unevenness (jogs) guide unit consisting of a plurality of convex stripes and adjacent concave grooves is provided on a base plate of the drafting member, and the recording is carried out on the paper which is disposed on the unevenness guide unit, and the paper is under pressure at a lower stream of a recording position by means of the spur type roller thereby preventing the paper floating.

In order to prevent the paper floating by providing convex portions or ribs on the platen or by positioning a portion of the paper that is curved downward at the concave portions formed between the convex portions or the ribs, there is a necessity of forcing the lower surface of the paper to contact the convex portions or the ribs. The conventional device has a construction wherein the projections of the paper holding plate are caused to contact the paper before it comes to the printing unit or the paper is caused to make a curve by the paper guide before it comes to the printing unit, and the paper is caused to contact the ribs by means of the pressure. However, the projections of the paper holding plate cannot be disposed in the vicinity of a printing area so that the paper cannot be caused to contact the convex portions. Also, a method of causing the paper to contact the ribs by taking advantage of the curve of the paper cannot obtain a sufficient pressurizing force.

Furthermore, in case of using the drafting member having a flat perforated paper support surface, the paper that absorbs the ink at the time of recording inflates. The suction device causes problems such as the inflated portion is not adsorbed onto the paper support surface by vacuum force, or the paper floating occurs that causes the recording head rubs on the paper. In addition, when the paper is caused to be in direct contact with the spur type roller, an adverse influence occurs on the quality of picture and the spur type roller stains the paper after recording.

An object of the present invention is to solve the foregoing points.

SUMMARY OF THE INVENTION

In the present invention, the recording medium is sandwiched by the drive roller and the pinch roller, and the recording medium is carried onto the drafting member by the rotation of the drive roller. The recording head reciprocates in a direction perpendicular to a carrying direction of the recording medium on a print range of the drafting member to carry out the recording on the recording medium. A predetermined range of the drafting member and its movements before and after the recording is such that the suction force is produced by the suction device and the recording medium is attracted to the support surface of the drafting member. An unevenness (jogs) guide unit having suction holes is formed on the drafting member, and the cockling (wave-form rumples) of the recording medium is absorbed by the unevenness guide unit which prevents the paper floating. This unevenness guide unit comprises a plurality of convex portions that are arranged in a row which extends in the X-axis direction in parallel with the carrying direction of the recording medium and the adjacent concave portions, and suction holes open to the upper surface of the concave portion or the convex portion of the drafting member, or the suction holes open to the upper surface of both the concave portion and the convex portion.

Still, furthermore, in the present invention, a cut plateau that is lower than the paper support surface of the unevenness guide unit of the drafting member is formed on the lower stream side having a predetermined interval from a drafting position of the drafting member, and the second unevenness guide unit is provided in adjacency of the lower steam side of the cut plateau, and the height of the paper support surface of the second unevenness guide unit is arranged to be lower than the height of the paper support surface of the unevenness guide unit of the drafting member.

As described in the foregoing, the present invention generates the suction force at the drafting position and the paper support surface of the unevenness guide unit formed at its lower stream, which prevents the paper floating and eliminates the rubbing of the paper with the recording head. Moreover, the recording of high picture quality can be carried out as the inflated portion of the paper that absorbs the ink adsorbs onto the unevenness guide unit by means of the contactless vacuum force.

Furthermore, the present invention generates the vacuum force on the upper surface of the convex stripes by perforating the suction holes for adsorption on the convex stripes so that the floating of the recording medium can be prevented efficiently. Moreover, the inflated portion of the recording medium that absorbs the ink is adsorbed onto the unevenness guide unit by means of the contactless vacuum force whereby an interval between the recording head and the recording medium is set constant, which carries out the recording of high picture quality.

DETAILED DESCRIPTION OF THE INVENTION

Embodiments of the present invention will be described in details in the following by referring to attached drawings.

Figure 2:
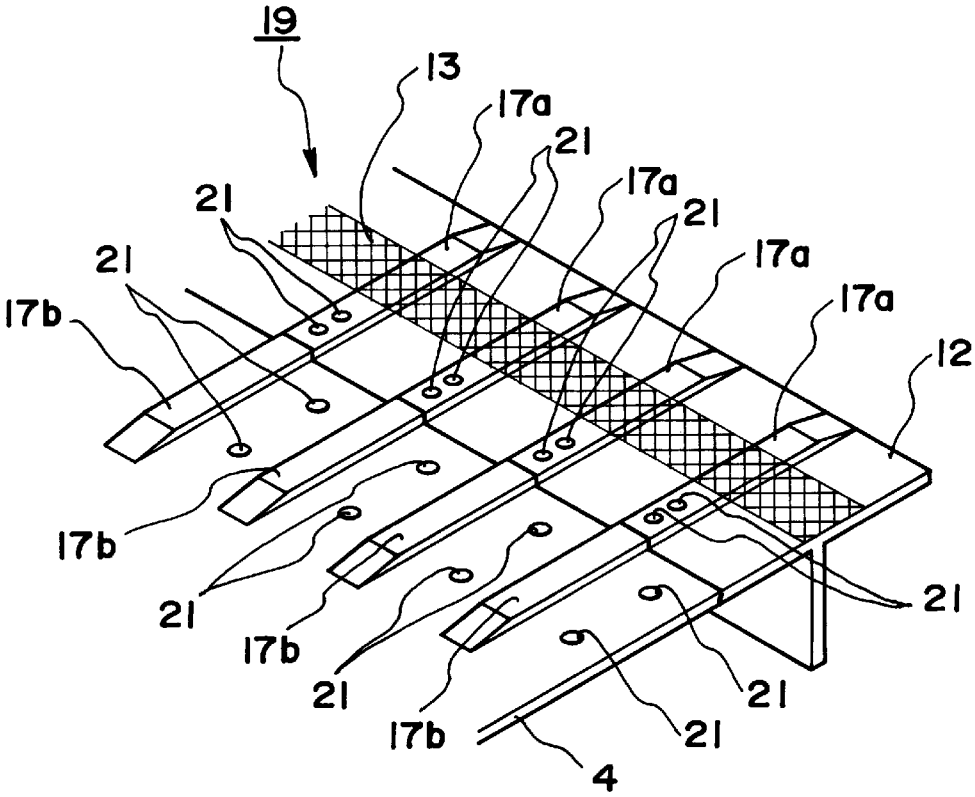
FIG. 2 is an exterior view of an unevenness guide unit of the inkjet printer.
Figure 3:
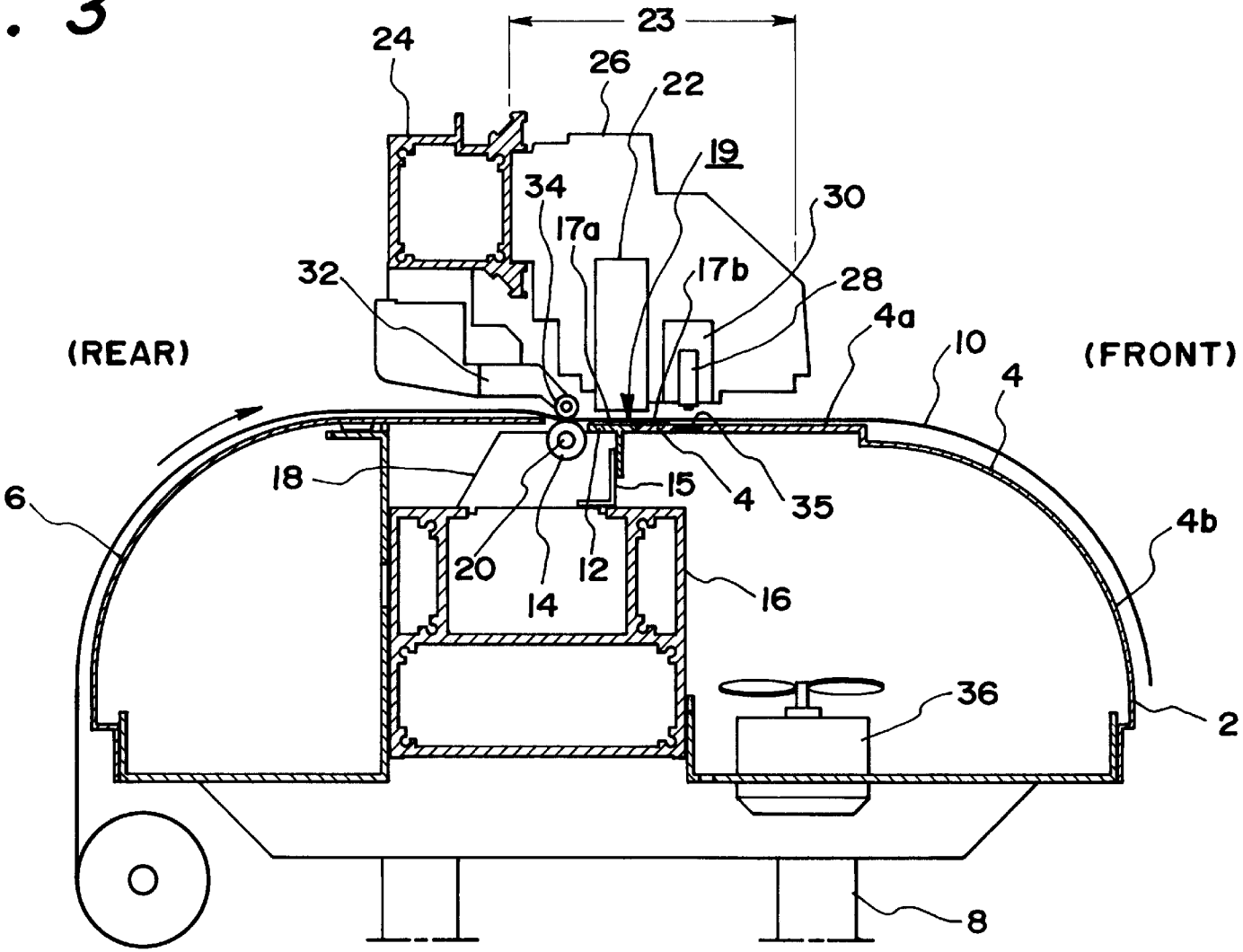
FIG. 3 is a side view cross section of the inkjet printer.

In FIG. 3, reference numeral (2) designates a platen of an inkjet type large size printer (plotter), and is provided with a front paper guide (4), a drafting member (12), and a rear paper guide (6). The platen (2) is journalled on a stand (8). The paper guides (4), (6) have a breadth that is wider than a width of the paper, and is disposed to guide the paper, namely, a recording medium (10) from the rear of the platen (2) to the front. The drafting member (12) is positioned at almost the center of the platen (2), and the printing is arranged to be carried out on the upper surface of a print range (13) (refer to FIG. 2) of the drafting member (12).

The drafting member (12) is fixed to a base (16) by means of a bracket (15). A plurality of convex portions **(17*a*) that extend in the carrying direction of the paper are fixed in a row on the drafting member (12). A plurality of convex portions (17*b*) are fixed in parallel on the upper surface of the front paper guide (4) that is adjacent to the drafting member (12) so that the convex portions (17*b*) are continuous with the convex portions (17*a*), and an unevenness guide unit (19) for prevention of paper floating is formed in a predetermined range of the upper surface of the drafting member (12) and a portion of the front paper guide (4) that is adjacent to the drafting member (12) by means of the convex portions (17*a*), (17*b*). A plurality of suction holes (21) for adsorption are perforated on the convex portion (17*a*) and the front and rear paper guides (4), (6), and thus, the vacuum force is arranged to work against the paper in a predetermined range (23) of the front and rear of the print range (13) of the drafting member (12). The suction hole (21) perforated on each convex portion (17*a*) is disposed at a position slightly staggered in the lower stream direction from the print range (13)**.

In the gap formed in an opposed portion of the drafting member (12) and the rear paper guide (6), a long size drive roller (14) is disposed, and the drive roller (14) is mounted on a drive shaft (20). The drive shaft (20) is rotatably journalled on a shaft holder (18) fixed to a base frame (16) in the platen (2), and is connected to an X motor that is controlled by a controller by means of a power transmitting mechanism. Reference numeral (22) denotes an inkjet type recording head that is mounted on a carrier (26) that is mounted shiftably on a Y-axis guide rail (24) that extends along a paper surface perpendicular direction, namely, the Y-axis in FIG. 3. A cutter head (30) that holds a cutter (28) liftably is mounted on the carrier (26).

The carrier (26) is connected to a Y motor that is controlled by the controller reciprocatingly along the Y-axis guide rail (24). The Y-axis guide rail (24) is mounted on the platen (2), and a plurality of roller holders (32) are liftably journalled on the Y-axis guide rail (24) by means of a lift guide (illustration is omitted). A pinch roller (34) is rotatably journalled on each of the roller holders (32). The pinch roller (34) is in resilient contact on the surface of the drive roller (14) by the spring force that works on the roller holder (32), and the recording medium (10) that is disposed on the platen (2) is sandwiched by mutual operation with the drive roller (14). Reference numeral (35) designates a cutter mat for performing a paper cut, and is disposed in parallel with the drafting member (12), and the cutter mat (35) is fixed to the front paper guide (4). Reference numeral (36) denotes a vacuum (suction) device, and is arranged to produce the vacuum force by the device over the drafting member (12) and the undersurface of the recording medium (10) on the platen (2) in a predetermined range (23) by means of the suction hole (21).

The operation of the embodiment of the present invention will be described in the following.

Figure 1:
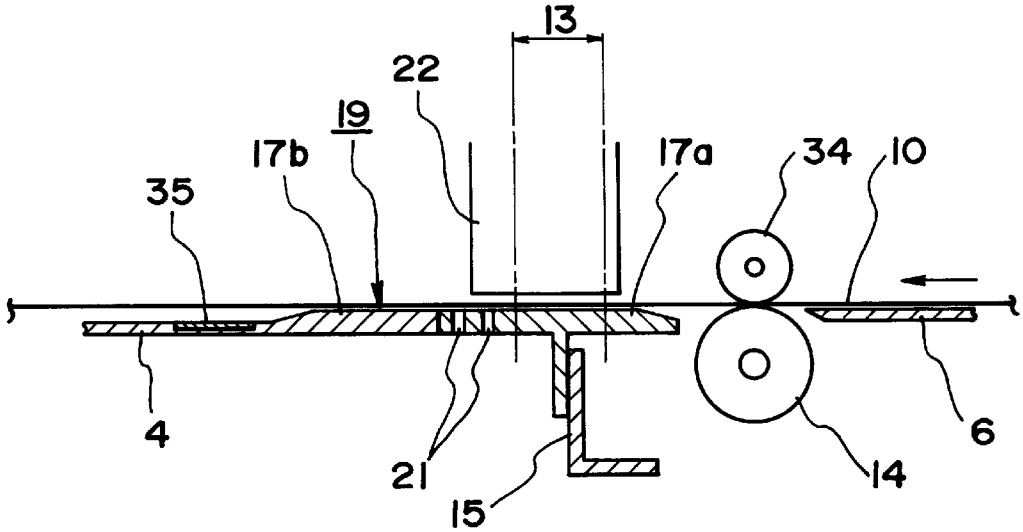
FIG. 1 is a side view cross section of an essential portion of an inkjet printer according to the present invention.

The recording medium (10) such as the pull-out portion of the rolled paper or the cassette paper which is mounted on the rear paper guide (6) is sandwiched between the drive roller (14) and the pinch roller (pressure roller), and is carried in the right and left direction in FIG. 1 while it being subjected to receiving the vacuum pressure of downward direction on the drafting member (12) by the intermittent rotation of the drive roller (14) in a counter clockwise direction in FIG. 1. When the ink is absorbed by the recording medium (10) on the drafting member (12), an elongation due to the inflation occurs in the concave portion of the unevenness guide unit (19). At this time, the recording medium (10) is in pressurized condition over the upper surface of the concave portion **(17*a*) by the suction hole (21) of the convex portion (17*a*) so that the waving (cockling) generates positively in the downward direction that positions the curved portion arising from the cockling at the concave portion and as a result, the recording medium (10) seldom floats in the direction of the recording head (22) from the drafting member (12)**.

The recording head (22) reciprocates in the Y-axis direction on the recording medium (10) that is in a tight contact with the paper support surface of the unevenness guide unit (19) of the drafting member (12), and the printing operation takes place on the recording medium (10) by the ink droplet to be discharged from the recording head (22). At the print time, even if the recording head (22) transfers to the side end portion (edge) of the recording medium (10), because of shifting of the suction hole (21) in the lower stream direction from the print range (13) as shown in FIG. 2, the ink droplet is seldom absorbed into the suction hole (21). The recording medium (10) after printing is carried onto the front paper guide (4) through the cutter mat (35) while it is receiving the vacuum force. Where the recording medium (10) is the rolled paper, after recording of one frame, the cut position of the recording medium (10) is positioned on the cutter mat, and the predetermined position of the recording medium (10) is cut along the Y-axis direction by a cutter (28).

Whereas the other embodiment of the present invention will be described in details in the following by referring to FIG. 4 through FIG. 8.

Figure 5:
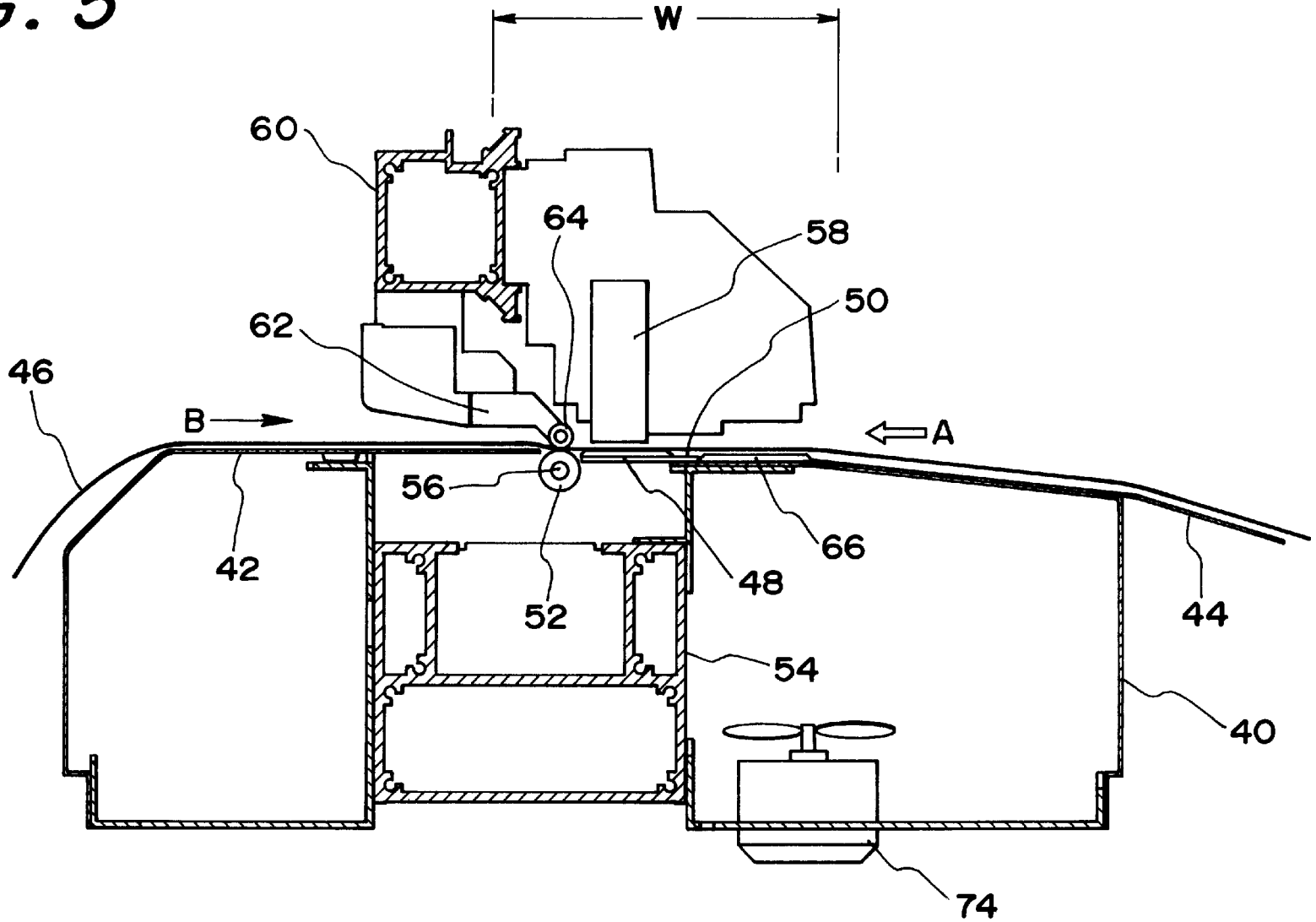
FIG. 5 is a schematic side view of the inkjet plotter.

In FIG. 5, reference numeral (40) designates a proper of an inkjet type plotter (printer), and is provided with a rear paper guide (42) and a front paper guide (44). The proper (40) is journalled on the stand (illustration is omitted). The paper guides (42), (44) have a breadth broader than a width of the paper, and is disposed to guide the paper (46), namely, the recording medium (46) from the upper stream side to the lower stream side at the drafting position. The drafting member (48) is disposed at the drafting position, and a cut plateau (50) of a predetermined width that extends in the Y-axis direction is integrally formed on a base plate (48*a*) of the drafting member (48). The drafting member (48) is fixed to the proper (40).

A pair of drive rollers (52) (the other is not illustrated) is disposed at an opposite portion of the drafting member (48) and the rear paper guide (42), and a drive roller (52) is fixed to a drive shaft (56) journalled rotatably on a base (54). Reference numeral (58) denotes a recording head of inkjet type, and is mounted on a Y-axis guide rail (60) reciprocatingly along the paper surface perpendicular direction, namely, the Y-axis in FIG. 5. A pair of roller support arms (62) is rotatably journalled on the Y-axis guide rail (60), and a pinch roller (64) is rotatably journalled on the roller support arm (62).

The pinch roller (64) makes an elastic contact with the surface of the corresponding drive roller (52) by a spring force that works on the roller support arm (62), and sandwiches both sides of the recording medium (46) to be disposed on the paper guides (42), (44) by the mutual operation with the drive roller (52). The base plate (48*a*) of the drafting member (48) is fixed to a guide member (66) with difference in level. The first unevenness guide unit (68) is formed on the base plate (48*a*) of the drafting member (48) which is positioned at the upper stream side of the cut plateau (50), and the second unevenness guide unit (70) is formed on the base plate (66*a*) of the guide member (66) which is positioned at the lower stream side of the cut plateau (50).

Figure 4:
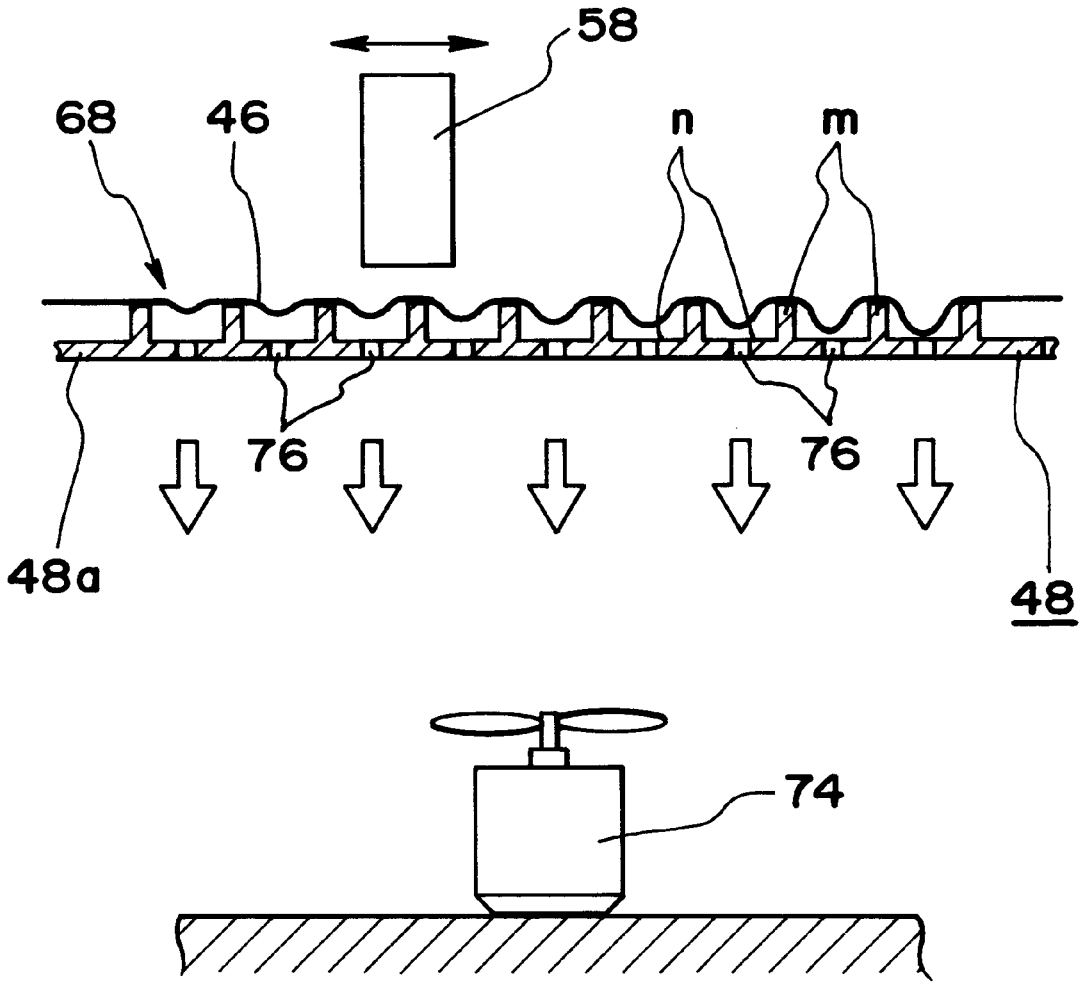
FIG. 4 is an elevation descriptive view showing another embodiment of the inkjet printer according to the present invention.

In the first unevenness guide unit (68), as shown in FIG. 4, a plurality of convex portions (m) that extend in the X-axis direction are formed in a row at an almost even interval on the base plate (48*a*), and in the convex portion (m), a plurality of concave portions (n) that extend in the X-direction are formed on the surface of the base plate (48*a*). At the end portion of the side of each of the convex portion that is in contact with the cut plateau (50), an inclined surface (72) is formed. Similarly, in the second unevenness guide unit (70), a plurality of the convex portions (m) are formed in a row, and in the convex portions (m), a plurality of the concave portions (n) that extend in the X-axis direction are formed on the surface of the base plate (66*a*). The height of the paper support surface of the second unevenness guide unit (70) is set lower than that of the paper support surface of the first unevenness guide unit (68) and also is set at a height slightly higher than the cut plateau (50).

At the end portion of the side where each convex portion (m) of the second unevenness guide unit (70) is in contact with the cut plateau (50), an inclined surface (72) is formed. Reference numeral (74) designates a suction device to be driven by a motor, and is fixed to the proper (40). The suction device (74) is constructed as such that the suction force is generated over a range W on the surface of the paper carrying path consisting of the paper guides (42), (44), drafting member (48) and the guide member (66). A plurality of suction holes (76) that are communicated with the suction device (74) are formed on portions belonging to the suction force generating area (W) of the paper guides (42), (44), drafting member (48) and the guide member (66).

The operation of the embodiment of the present invention will be described in the following.

The recording medium (46) such as a pull-out portion of the rolled paper or the cut paper and the like which is mounted on the rear paper guide (42) is sandwiched by the drive roller (52) and the pinch roller (64), and is carried in the arrow direction (B) while it is receiving the vacuum force in the downward direction over the drafting member (48) by the intermittent rotation of the drive roller (52) in the clockwise direction in FIG. 5. The inflated portion of the recording medium (46) that absorbs the ink on the drafting member (48) is absorbed into the concave portion (n) as shown in FIG. 4, and the recording medium (46) contacts tightly on the paper support surface formed of the upper end of the convex portion (m). The recording head (58) shifts reciprocatingly on the recording medium (46) that is in tight contact with the paper support surface of the drafting member (48) in the Y-axis direction, and the printing operation is taken place on the recording medium (46) by the ink that is discharged from the recording head (58).

The recording medium (46) after printing is carried to the second unevenness guide unit (70) through the cut plateau (50) while it is receiving the vacuum force, and is carried onto the front paper guide (44) while it being in tight contact with the paper support surface formed of the upper end of the convex portion (m) of the unevenness guide unit (70). In the case where the recording medium (46) is the rolled paper, the cut position of the recording medium (46) is positioned on the cut plateau (50) after recording of one frame, and a predetermined position of the recording medium (46) is cut by a cutter (not illustrated) that is provided on a carriage that holds the recording head (58).

In the case where the first and the second unevenness guide units (68), (70) are set on an identical plane as shown in FIG. 8(A), and the cut plateau (50) is set at a lower position, there is a possibility that the tip of the recording medium (46) engages the convex portion (m) of the second unevenness guide unit (70) at the lower stream side. Furthermore, in the case where the unevenness guide units (68), (70) and the cut plateau (50) are set on an identical plane as shown in FIG. 8(B), the cockling (wave-form rumple) (46*a*) of the recording medium (46) swells in the upward direction on the cut plateau (50), and as a result, the recording medium (46) rises from the first unevenness guide unit (68), namely, the drafting position which ends up with the adverse influence on the drafting.

Figure 6:
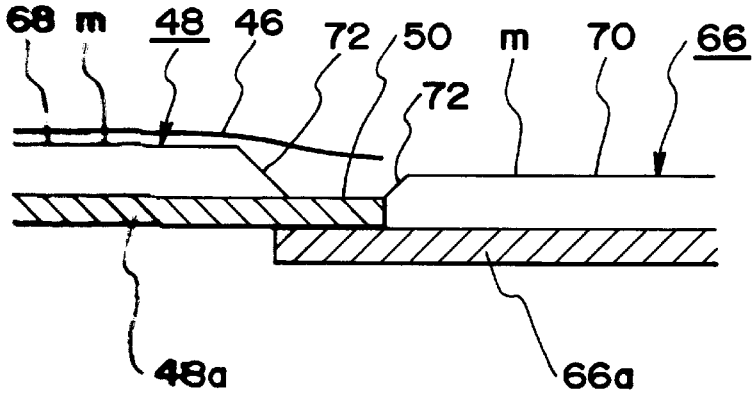
FIG. 6 is a descriptive side view cross section showing another embodiment according to the present invention.
Figure 7:
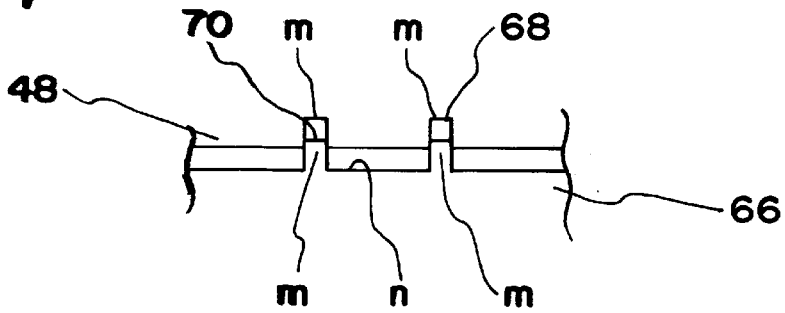
FIG. 7 is an elevation of a part of the unevenness guide unit that takes a view in an A direction of FIG. 5.
Figure 8:
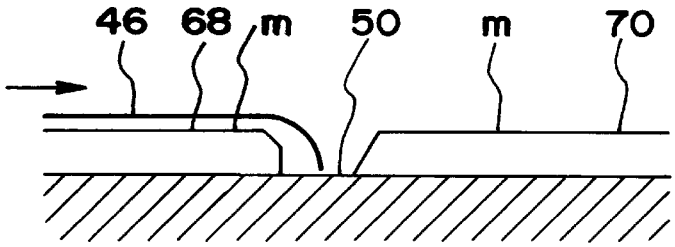
FIG. 8 is a descriptive view for explanation of operation of another embodiment according to the present invention.
Figure 8:
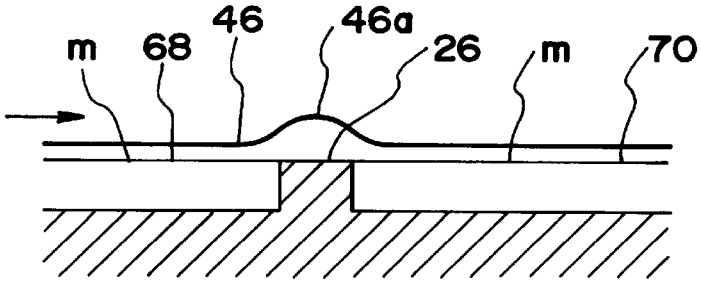

In this embodiment, a difference in level is formed between the first unevenness guide unit (68) at the upper stream side and the second unevenness guide unit (70) at the lower stream side with the cut plateau (50) as the border as shown in FIG. 6 so that the engagement of the tip of the recording medium (46) as shown in FIG. 8(A) or the floating phenomenon of the recording medium (46) as shown in FIG. 8(B) can be prevented. Whereas, the unevenness guide units (68), (70) of this embodiment are formed by the convex portion (m) and the concave portion (n) that extend in the Y-axis direction, but there is no particular limitation in the regular arrangement or the direction as mentioned in the foregoing.

What is claimed is:

1. An inkjet printer, which printer sandwiches at least both sides of a recording medium by means of a drive roller and a pinch roller, and the recording medium is carried to a paper guide at the lower stream side from the upper stream side of a drafting member through the drafting member, and the recording is carried out by means of a recording head on the recording medium at a drafting position of the drafting member, an improved inkjet printer wherein a suction device is provided for generating a suction force in order to force the recording medium to contact a support surface of the drafting member in a print range, and suction holes that communicate with the suction device and an unevenness guide unit are provided on the drafting member.

2. An inkjet printer according to claim 1, wherein a suction hole is provided on a concave portion of the unevenness guide unit.

3. An inkjet printer according to claim 1, wherein the suction hole is provided on a convex portion of the unevenness guide unit.

4. An inkjet printer according to claim 1, wherein the unevenness guide unit comprises a plurality of convex portions arranged in a row which extend in an X-axis direction in parallel with a carrying direction of the recording medium and concave portions that are adjacent to the convex portions, and an upper end of each convex portion that are disposed in a row forms a paper support surface.

5. An inkjet printer, which sandwiches the drive roller and the pinch roller and carries the recording medium to the paper guide at the lower stream side from the upper stream side of the drafting member through the drafting member by the rotation of the drive roller, and performs the recording on the recording medium over the drafting member by means of the recording head, an improved inkjet printer, wherein a suction device is provided for generating a suction force that forces the recording medium to contact with the support surface in a print range of the drafting member, and an unevenness guide unit including a plurality of convex portions arranged in a row is provided on the drafting member or the paper guide that is adjacent to the drafting member, and suction holes that communicate with the suction device are formed on the upper surfaces of the convex portions, and the lower surface of the recording medium is caused to contact tightly on the upper surfaces of the convex portions by means of the suction force of the suction device.

6. An inkjet printer according to claim 5, wherein the suction holes that communicate with the suction device are formed on the concave portions of the unevenness guide unit.

7. An ink jet printer according to claim 1, wherein the unevenness guide unit is a first unevenness guide unit and the support surface forms part of the first unevenness guide unit; the ink jet printer further comprising:

a cut plateau disposed lower than the support surface spaced apart from the drafting member at a lower stream side of the first unevenness guide unit; and a second unevenness guide unit, having a second paper support surface, disposed adjacent to the cut plateau at a lower stream side of the cut plateau, wherein a top of the second paper support surface is positioned lower than a top of the paper support surface of the first unevenness guide unit.

8. An inkjet printer for printing on a recording medium, comprising:

a recording head for printing on the recording medium in a print range of the inkjet printer and disposed between an upstream side and a downstream side of said inkjet printer;

a drive roller and a pinch roller that sandwich the recording medium for conveyance in said inkjet printer from said upper stream side to said lower stream side;

a paper guide disposed on the lower stream side of the inkjet printer;

an unevenness guide unit disposed in the print range of the inkjet printer and extending downstream of the print range;

a suction device; and suction holes disposed in said unevenness guide unit and communicating with said suction device; and wherein said inkjet printer is adapted to operate said suction device to suck the recording medium while the recording medium is being printed on by said recording head.

9. The inkjet printer according to claim 8, wherein said unevenness guide unit comprises longitudinal convex portions extending in a conveyance direction of the recording medium interspersed with concave portions extending in the conveyance direction of the recording medium.

10. The inkjet printer according to claim 9, wherein said suction holes are disposed in said convex portions.

11. The inkjet printer according to claim 9, wherein said suction holes are disposed in said concave portions.

12. The inkjet printer according to claim 9, wherein said suction holes are disposed in both said convex portions and said concave portions.

* * * * *